US008387524B2

(12) United States Patent
Karlsson et al.

(10) Patent No.: US 8,387,524 B2
(45) Date of Patent: Mar. 5, 2013

(54) APPARATUS AND METHOD FOR COMPENSATING FOR STRESS DEFORMATION IN A PRESS

(75) Inventors: Mikael Karlsson, Tranemo (SE); Bengt Walkin, Tranemo (SE)

(73) Assignee: Automation Presses Tooling AP&T AB, Tranemo (SE)

( * ) Notice: Subject to any disclaimer, the term of this patent is extended or adjusted under 35 U.S.C. 154(b) by 0 days.

(21) Appl. No.: 12/858,641

(22) Filed: Aug. 18, 2010

(65) Prior Publication Data

US 2010/0307217 A1 Dec. 9, 2010

Related U.S. Application Data

(62) Division of application No. 10/582,591, filed on Apr. 17, 2007.

(30) Foreign Application Priority Data

Dec. 17, 2003 (SE) ..... 0303402

(51) Int. Cl.
*B30B 13/00* (2006.01)

(52) U.S. Cl. ..... 100/35; 100/258 A

(58) Field of Classification Search ..... 100/35, 100/211, 258 R, 258 A, 269.02, 269.04, 295; 72/60

See application file for complete search history.

(56) References Cited

U.S. PATENT DOCUMENTS

| | | | | |
|---|---|---|---|---|
| 2,066,085 | A * | 12/1936 | Whistler | 101/32 |
| 2,107,587 | A * | 2/1938 | Smith | 162/399 |
| 4,423,674 | A | 1/1984 | Thies | |
| 4,854,994 | A * | 8/1989 | Breiter et al. | 156/228 |
| 6,314,873 | B1 | 11/2001 | Lee et al. | |
| 2003/0188643 | A1 | 10/2003 | Musse | |
| 2005/0076699 | A1 | 4/2005 | Kruger et al. | |

FOREIGN PATENT DOCUMENTS

| | | | |
|---|---|---|---|
| DE | 1703297 | A | 2/1972 |
| DE | 19937694 | A1 | 2/2001 |
| DE | 10043030 | A1 | 3/2002 |

* cited by examiner

*Primary Examiner* — Jimmy T Nguyen
(74) *Attorney, Agent, or Firm* — Bachman & LaPointe, P.C.

(57) ABSTRACT

A method for locally increasing pressing pressure on a press tool having an abutment surface for being clamped onto a clamping surface in a press comprises providing a power unit smaller than the abutment surface and having an internal space, positioning the power unit between the clamping surface and the abutment surface, pressing the clamping surface against the abutment surface, connecting the internal space to a source of pressurized hydraulic fluid, and supplying the pressurized hydraulic fluid to the internal space thereby causing the power unit to expand and to exert a local pressure on the abutment surface.

10 Claims, 10 Drawing Sheets

APPARATUS AND METHOD FOR COMPENSATING FOR STRESS DEFORMATION IN A PRESS

CROSS REFERENCE TO RELATED APPLICATION(S)

This application is a divisional application of U.S. patent application Ser. No. 10/582,591, filed Apr. 17, 2007, entitled APPARATUS AND METHOD FOR COMPENSATING FOR STRESS DEFORMATIONS IN A PRESS.

BACKGROUND (1) Field of the Invention

The present invention relates to an apparatus for compensating for such deformations as occur in first and second clamping surfaces intended for a tool in a press, the clamping surfaces being reciprocally moveable towards and away from one another for moving a first and a second part of the tool towards and away from each other, respectively, such deformations generating an uneven pressure in at least one area of contact between the tool and the clamping surfaces.

(2) Prior Art

In hydraulic presses, tools are positioned by means of which different objects are compression moulded to the desired configuration and appearance. Hydraulic presses operate at high pressure, which results in the parts in the hydraulic press, as well as the tool placed in the hydraulic press, being subjected to extreme stresses. These stresses are so great that the parts of the hydraulic press and the tool are deformed. This deformation results in the pressure distribution in those tools which are to impart to the final product its configuration and appearance becoming uneven. For example, the pressure will be lower in the centre of the tool and greater in its periphery. This will have as a result that the end product will be unevenly formed and will have an unacceptable quality.

In order to compensate for this deformation and distribute the pressure more evenly in presses, use has hitherto been made of shims, a form of interlay placed in between tools and the work surfaces of the hydraulic press. Cambering or crowning are also previously known methods for compensating for deformations. Cambering or crowning implies that those surfaces which are deformed during the pressing operation are arched so as to compensate for the deformation so that the compression pressure is distributed more evenly.

The drawbacks inherent in prior art technology are numerous. In the utilisation of shims, there is, granted, obtained a compensation for the deformation, but accurate setting is required and, this not withstanding, the compensation will be incomplete and above all not constant, but the compensation itself must be repeated at regular intervals. This results in unnecessary time loss for the compensation which lowers production capacity for the press. Another drawback inherent in shims is further that the thickness of the shims is given and not variable. Accuracy using shims is also difficult to achieve, which has a negative effect on the quality of the product produced using the tool in the press.

The drawback inherent in cambering or crowning is that the arching which is created is difficult to change in a simple manner if required. This lack of flexibility also results in considerable time loss when a new tool is to be positioned in a press. A cambering or crowning of the work surfaces of the press customised for the tool must then be utilised. Hence, cambering or crowning shows a low level of flexibility.

That which has hitherto been lacking in the art is an apparatus which is flexible and which can assume a thickness which fits a given situation in order to compensate for deformation in a press. In addition, there has been a lack of an apparatus which simply and rapidly can be adapted to a new tool disposed in a press. An apparatus for compensation of deformation which has a short adjustment time for a new tool and which thereby increases productivity in a press has long been sought for in the art. Further, a compensation apparatus which can compensate by bulging outwards has also been called for.

SUMMARY OF THE INVENTION

The object of the present invention is to obviate or at least minimize the above-outlined drawbacks, the object being attained by means of an apparatus which is characterised in that there is disposed, at least in a contact region between a clamping surface and an abutment surface, a power unit which, on activation, is operative to urge, away from the clamping surface located in the contact region, at least a part of the abutment surface of the tool located there.

The object of the present invention is to realise an apparatus which is flexible and which can compensate for deformations by bulging outwards and thereby realising a compensation for deformations so that a more uniform compression depth is attained in a tool which is placed in a press in which the present invention has been disposed.

The present invention enjoys the following advantages. The apparatus according to the present invention may be formed and given a thickness which is sufficiently great where required and sufficiently thin where required over a surface in a press, in order thereby to compensate for deformations which occur. The high level of flexibility of the invention makes it easier to compensate for a new tool which is placed in the press, which results in shorter retooling time and higher production capacity in the press. Thus, the apparatus according to the invention enjoys the advantage that its thickness is variable.

BRIEF DESCRIPTION OF THE ACCOMPANYING DRAWINGS

The present invention will now be described in greater detail hereinbelow, with reference to the accompanying Drawings. In the accompanying Drawings.

DETAILED DESCRIPTION

Figure 1:
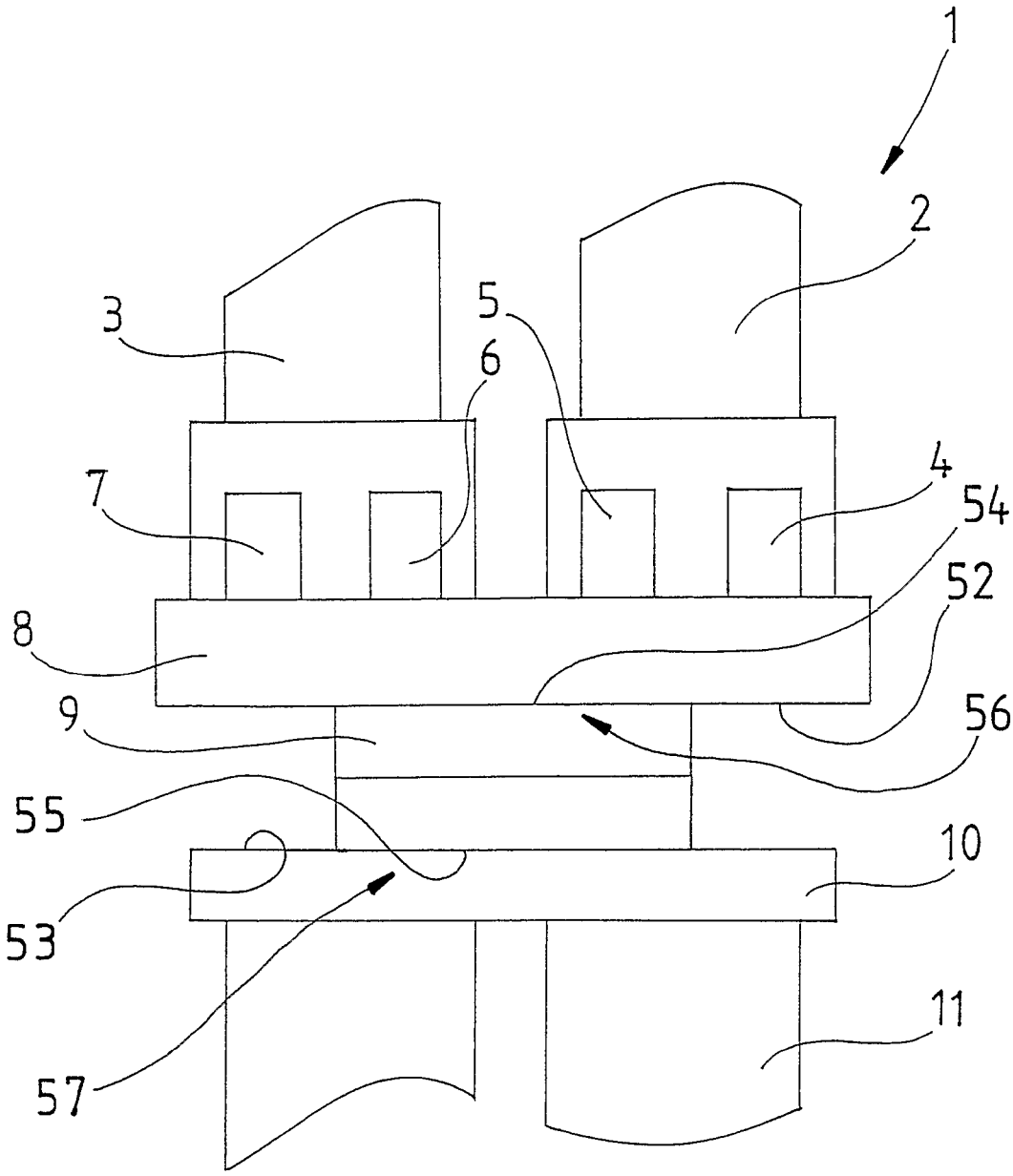
FIG. 1 is a side elevation of a hydraulic press in which a tool has been placed, in which tool a product may be pressed to the desired appearance.

FIG. 1 shows a hydraulic press 1 in which two large press cylinders 2, 3 together with four smaller press cylinders 4, 5, 6 and 7 act on a slide 8. Beneath the slide, a tool 9 is disposed which rests on a work table 10. The lower part 11 of the hydraulic press is disposed beneath the work table 10.

The tool 9 is of dual construction and has an upper part which is fixed in the slide 8 and a lower part which is fixed on the work table 10.

The illustrated type of hydraulic press 1 operates as follows. Between the slide 8 and the work table 10, the tool 9 is positioned. In this tool 9, there is placed a work piece (blank) which is to be formed by this tool. When the work piece is in place in the tool 9, the slide 8 presses the tool 9 against the work table 10 with the aid of the press cylinders 2, 3, 4, 5, 6 and 7. Once these press cylinders have acted for a given time interval which is sufficiently long for the work piece placed in the tool 9 to have achieved the desired configuration, the compression force of the press cylinders is reduced so that the ready-pressed work piece can be removed from the tool 9. There is further marked in FIG. 1 a first clamping surface 52 on the slide 8, as well as a second clamping surface 53 on the work table 10. The first clamping surface 52 on the slide 8 extends over the slide and abuts against a first abutment surface 54 on the tool 9. The second clamping surface 53 extends over the entire work table 10 and abuts against a second abutment surface 55 on the tool 9. A contact region 56 thereby occurs between the first clamping surface 52 on the slide 8 and the first abutment surface 54 on the tool 9. A further contact region 57 occurs between the second clamping surface 53 on the work table 10 and the second abutment surface 55 on the tool 9. It is in the contact regions 56, 57 that the compression pressure from the press cylinders 2, 3, 4, 5, 6 and 7 is transferred between the slide 8 and the tool 9, as well as between the tool 9 and the work table 10. The abutment surfaces 54 and 55 extend out to an outer contour which defines each respective abutment surface.

Figure 2:
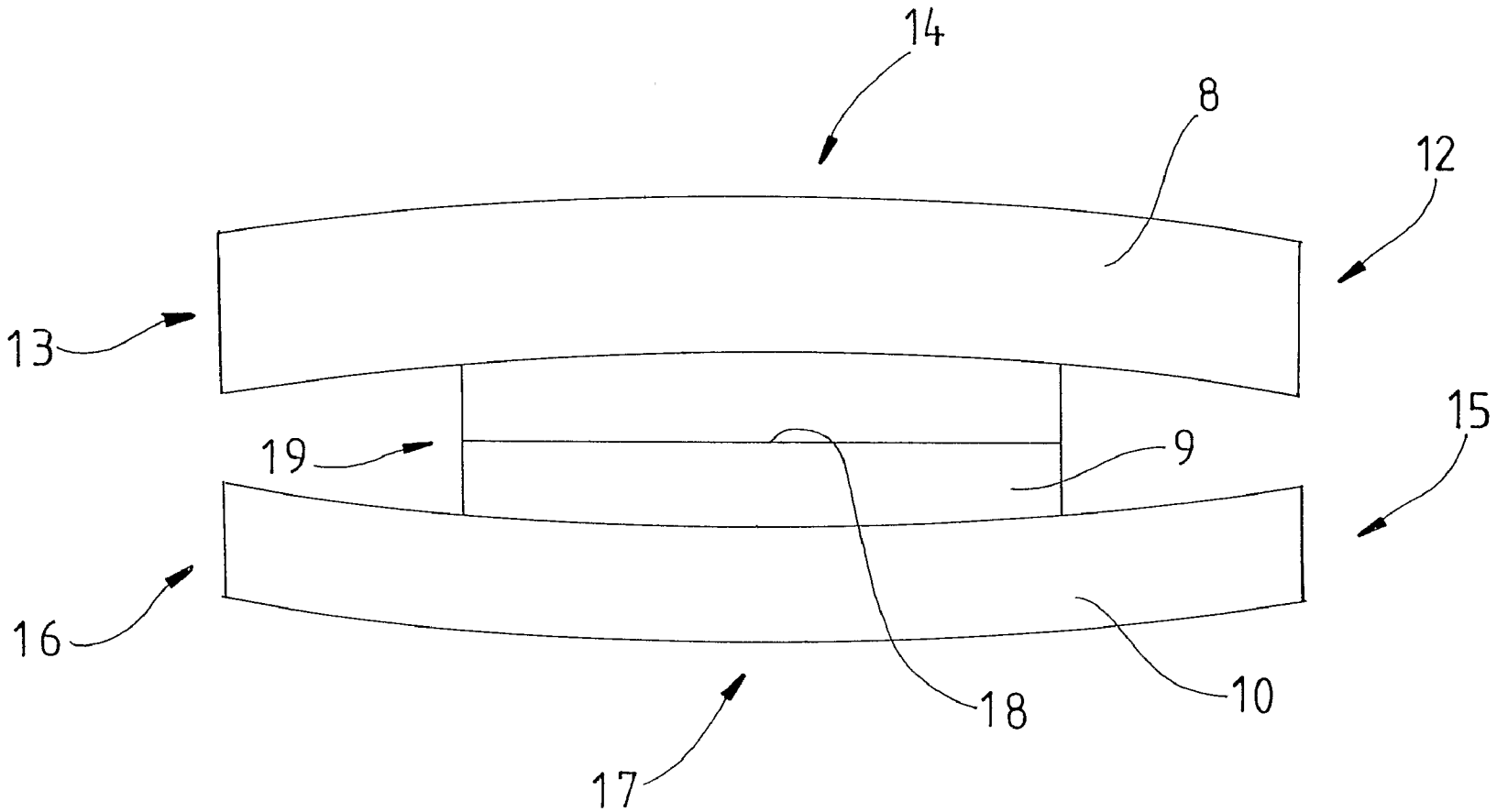
FIG. 2 is a side elevation showing how the tool is disposed between an upper slide and a lower work table and how both the slide and the work table are deformed during pressing.

FIG. 2 shows how both the slide 8 and the work table 10 are deformed when the hydraulic press operates. This deformation results in the compression pressure being distributed unevenly over both the slide 8, the tool 9 and also over the work table 10. It is this uneven distribution of the compression pressure which the present invention is intended to compensate for.

In one preferred embodiment of the present invention, the slide 8 and the work table 10 are manufactured of metal. At the elevated pressures at which a hydraulic press works, the metal may be likened to flexible rubber which bends when being subjected to the compression pressure. The result as far as the slide 8 is concerned will be that the outer parts 12, 13 of the slide 8 will be bent downwards, while a central part 14 is bent upwards.

The work table 10 is also bent when the compression force acts in the hydraulic press. The outer parts 15, 16 of the work table 10 are bent upwards, while a central area 17 of the work table 10 is bent downwards. That the central area 14 of the slide 8 is bent upwards and the central area 17 of the work table 10 is bent downwards will have as a consequence that a central part 18 in the tool 9 will have an insufficient compression pressure. A work piece which is placed in the tool 9 will be subjected to a compression pressure which varies over a press surface in the tool. In an outer portion 19, the compression pressure will be sufficiently great to form a work piece in a desired manner, i.e. the work piece will have the desired appearance and the desired compression depth. In a central area 18 of the tool 9, the compression pressure will, on the other hand, be too low which leads to the work piece not having the desired appearance and press depth. This is obviously unacceptable and the problem has been subject to various solutions, for example using shims or crowning. The present invention offers an apparatus whose purpose is to compensate for the deformation so that the difference between the compression pressure in the outer portion 19 and in the central area 18 will be as slight as possible in the tool 9.

Figure 3:
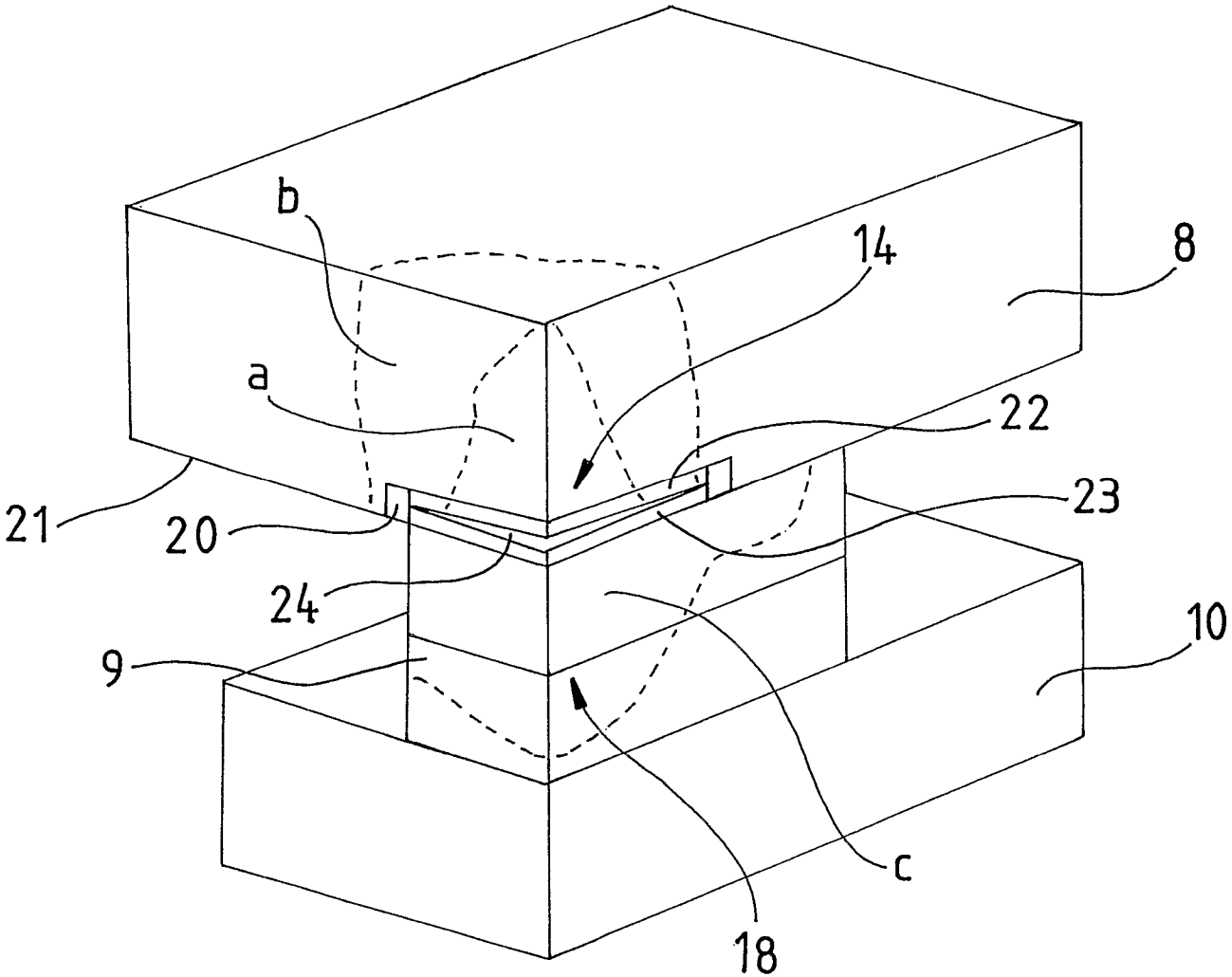
FIG. 3 is a perspective cross sectional view in which the cross section is in both the X and Y directions and shows how the apparatus according to the present invention is disposed between the upper side of the tool and the underside of the slide.

FIG. 3 shows how an apparatus 20 according to the present invention has been disposed in the underside 21 of the slide 8. The apparatus according to the present invention is placed in the central area 14 of the slide and above the central area 18 of the tool 9. FIG. 3, which is a perspective cross sectional view along a centre plane in both the longitudinal direction and the transverse direction of the slide 8, the tool 9 and the work table 10, shows how a first part 22 and a second part 23 are separated by an interspace 24 which is filled with a suitable liquid which, in the present embodiment, consists of oil. In that the interspace 24 may be increased or reduced throughout the entire surface where the apparatus is placed, with the aid of the pressure in the oil, a satisfactory compensation for the deformation in the slide 8 can be obtained.

FIG. 3 schematically shows how the compression pressure varies in the illustrated areas of the tool 9. In FIG. 3 is shown schematically how much material in the areas a, b in the slide 8 and an area c in the tool 9 move in the vertical direction. This change in the vertical direction corresponds to an increase of the compression pressure in the areas a, b, c. In the area a, the change in the vertical direction will be great as a result of the action of the apparatus 20 in the central area 14 of the slide 8. In the area b, the change will be somewhat less than in the area a, but also in this area the action from the apparatus 20 can be noted. In the area c, the action from the apparatus 20 can also be noted. Also in this area c, a change is realised in the vertical direction, which gives a compression pressure in the central area 18 of the tool 9.

Figure 4:
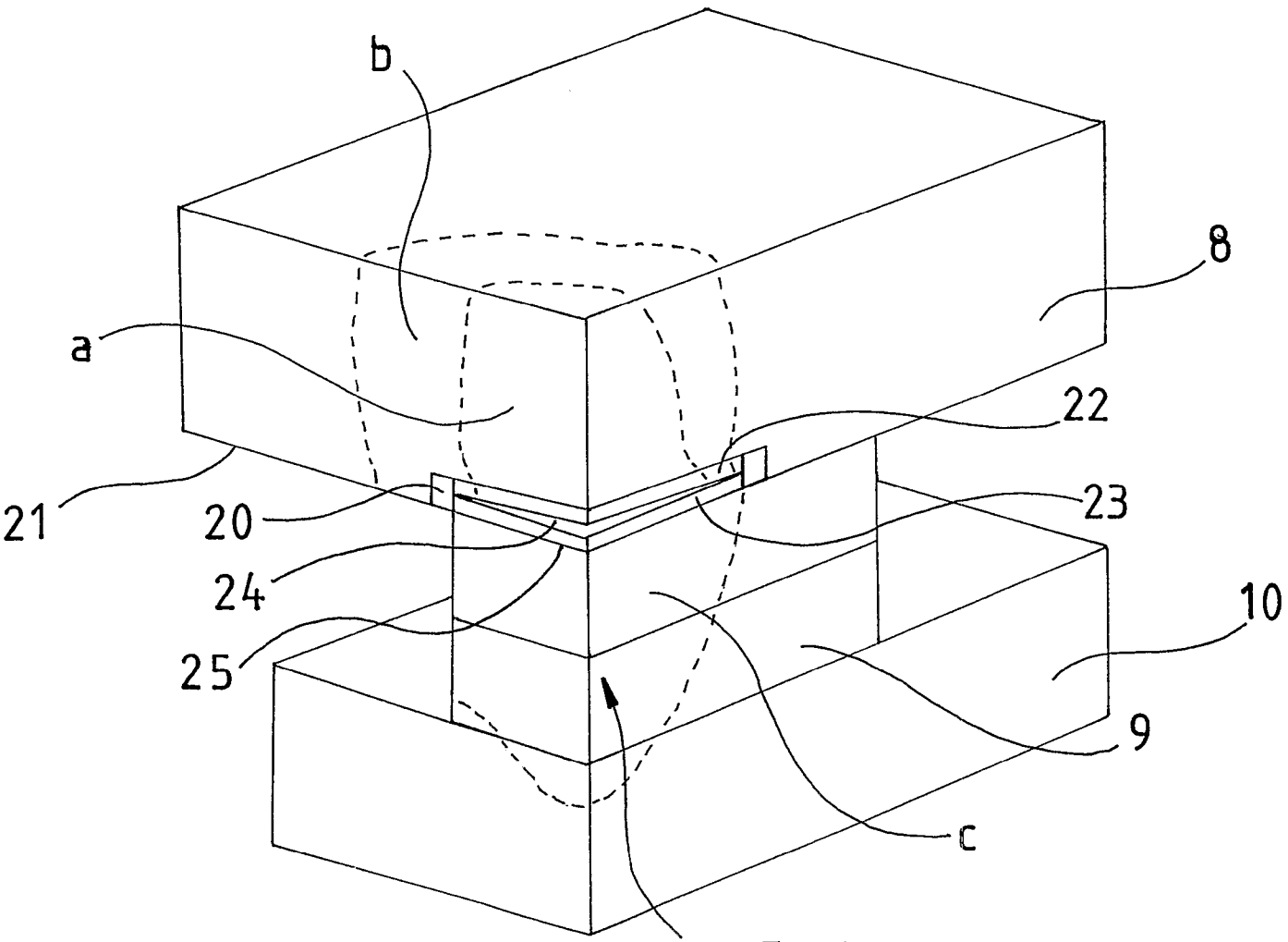
FIG. 4 shows the perspective cross sectional view of FIG. 3 where the apparatus according to the invention has been caused to expand further in order thereby to compensate further for the deformations and increase the compression force in the centre of the tool.

FIG. 4 is a similar view to FIG. 3, but in FIG. 4, the oil pressure in the interspace 24 in the apparatus 20 has been increased further, whereby the first part 22 is pressed harder against the underside 21 of the slide 8 and the second part 23 presses harder against an upper part 25 on the tool 9. By such means, the compression force in the central area 18 in the tool 9 increases. In FIG. 4, the increased pressure is shown in that the areas a, b, c have expanded. By the action from the apparatus 20, it will be apparent how the change in the vertical direction in the area c takes up a larger part of the central area 18 in the tool 9 in FIG. 4 than in FIG. 3. In FIG. 4, it may also be seen that this change in the vertical direction, i.e. an increase of the compression pressure, is propagated down also into the work table 10. By the action of the apparatus 20, the vertical change in the area a and the area b will also be greater in that the apparatus 20 has expanded. The illustrated areas a, b, c are shown schematically.

Figure 5:
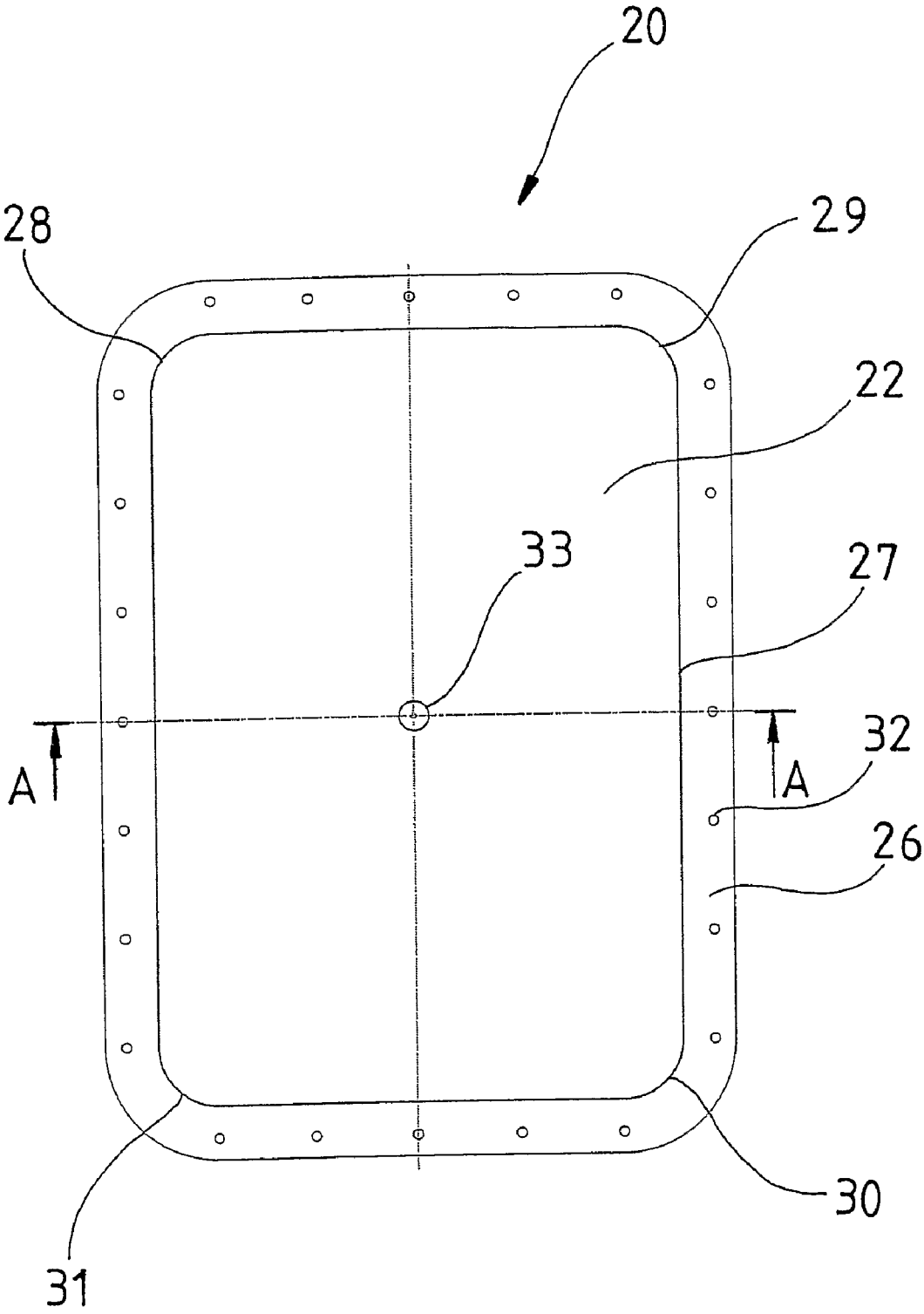
FIG. 5 is a plan view showing an upper part of the apparatus according to the present invention.

FIG. 5 shows in plan view the apparatus 20 for compensating for deformations. The apparatus 20 may be likened to a membrane which, from its initial appearance, can expand and act in this expanded state and thereafter return to its initial appearance when desired. The membrane 20 comprises a centrally disposed rectangular first part 22 which is surrounded by a frame section 26 which is welded together to the first part 22 along an upper welded joint. The upper welded joint extends all the way between the frame section 26 and the first part 22. The first membrane part 22 has rounded corners 28, 29, 30, 31. In the frame section 26, through-going holes 32 are provided through which, for example, screws may be passed for securing the membrane 20, for example on the clamping surface 21 (FIGS. 3 and 4) on a slide. Centrally in the rectangular first part 22 with rounded corners, a through-going hole 33 is provided.

The frame section 26 follows the appearance of the first part 22 and also has rounded corners.

Figure 6:
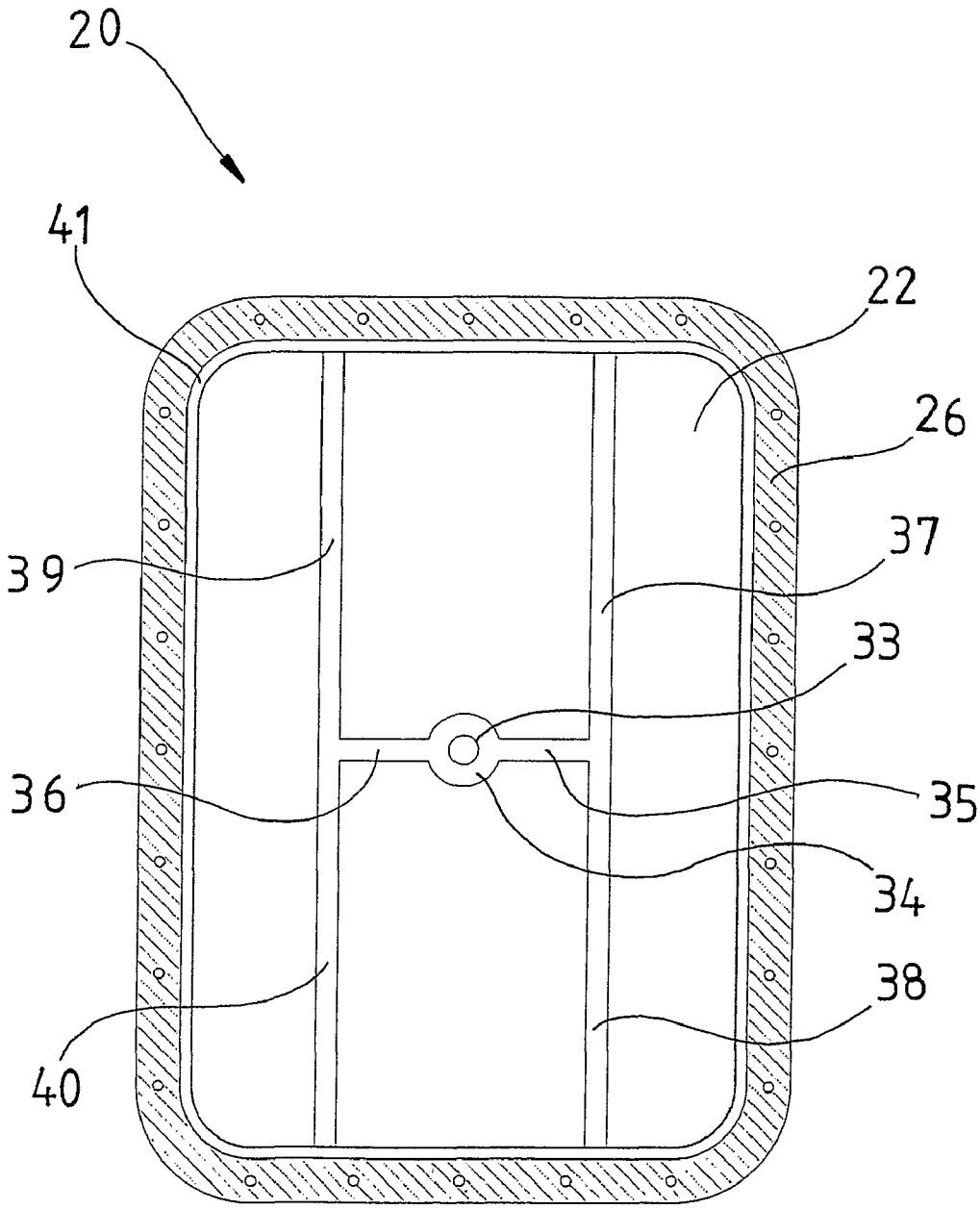
FIG. 6 is a plan view showing the underside of the upper part of the apparatus.

FIG. 6 shows in plan view a lower side of the first part 22 which the apparatus 20 includes, as well as the frame section 26 in cross section. The through-going hole is provided in the centre of the first part 22. About the hole 33, a circular recess 34 is provided. From this circular recess 34 extend grooves 35 out over the underside of the first part 22. In the illustrated embodiment of the invention, two grooves 35, 36 extend out from the circular recess 34. Each respective groove 35, 36 branches in a T curve to grooves 37, 38 and 39, 40, respectively which lead out to the outer edge of the first part 22. The through-going hole 33, the recess 34 and the grooves 35, 36, 37, 38, 39, 40 are designed so that the liquid, e.g. oil, will be capable of being fed into the membrane 20. It is naturally conceivable to design the pattern of grooves in many different ways. The grooves 37, 38, 39, 40 discharge in a circumferential groove 41 which is provided in the frame section 26. The circumferential groove 41 extends around the whole of the frame section.

Figure 7:
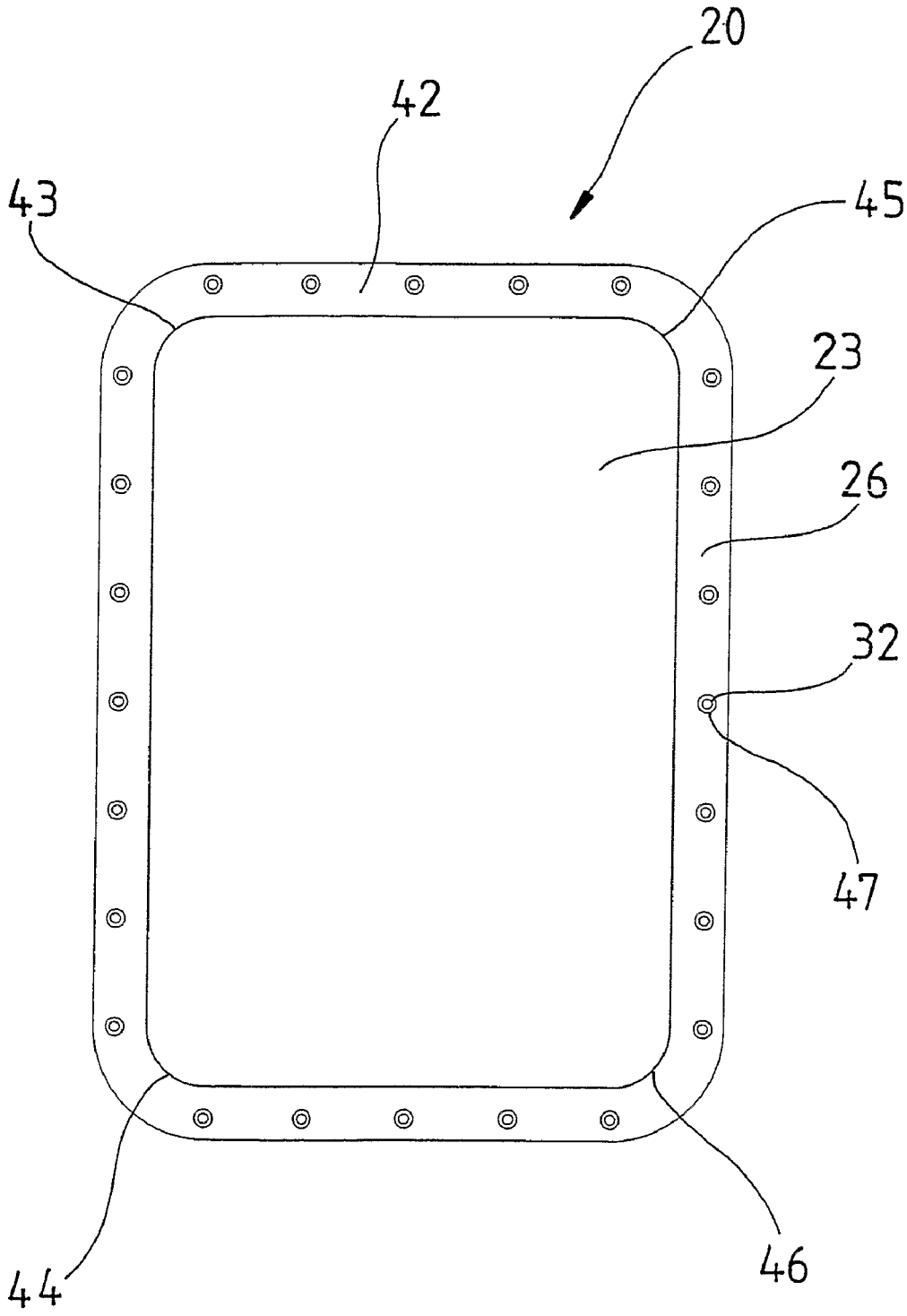
FIG. 7 is a plan view showing a second part of the apparatus.

FIG. 7 shows a plan view of the membrane 20 and also shows a second part 23 which is fixedly welded in the frame section 26 with a lower welded joint 42. The second part 23 is also a rectangular plate with rounded corners 43, 44, 45, 46. The frame section 26 surrounds the whole of the second part 23 and also has rounded corners which are in association with the rounded corners of the second part 23. In the frame section 26, holes 32 are provided and surrounded by a depression 47 which is to accommodate the head of a screw which is utilised for fixing the membrane 20 in, for example, the slide.

Figure 8:
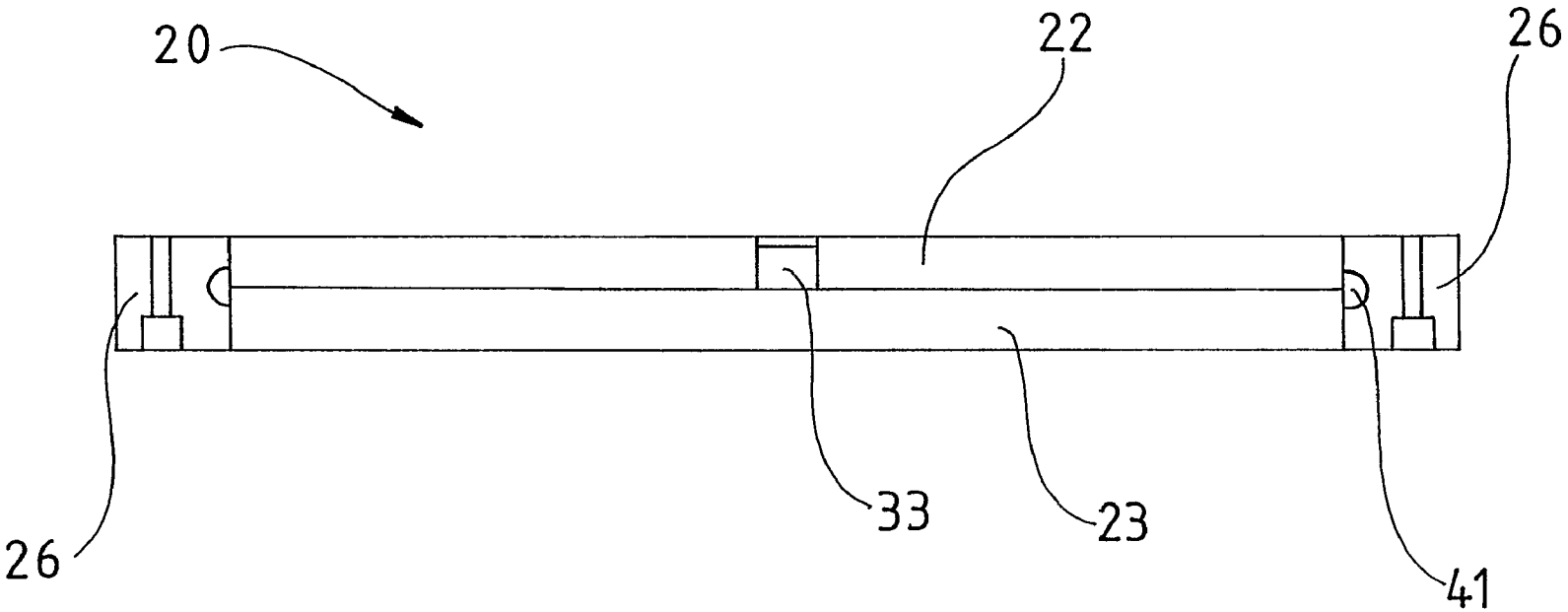
FIG. 8 is a side elevation in cross section through the apparatus according to the present invention.

FIG. 8 shows the membrane 20 in cross section along the plane A-A as shown in FIG. 5. In the figure, it is apparent how the first part 22 rests against the second part 23 and how the parts are disposed in relation to the frame section 26. Further, the figure shows the through-going hole 33 in the first part 22, as well as the circumferential groove 41 which is provided by recessing from the frame section 26.

Figure 9:
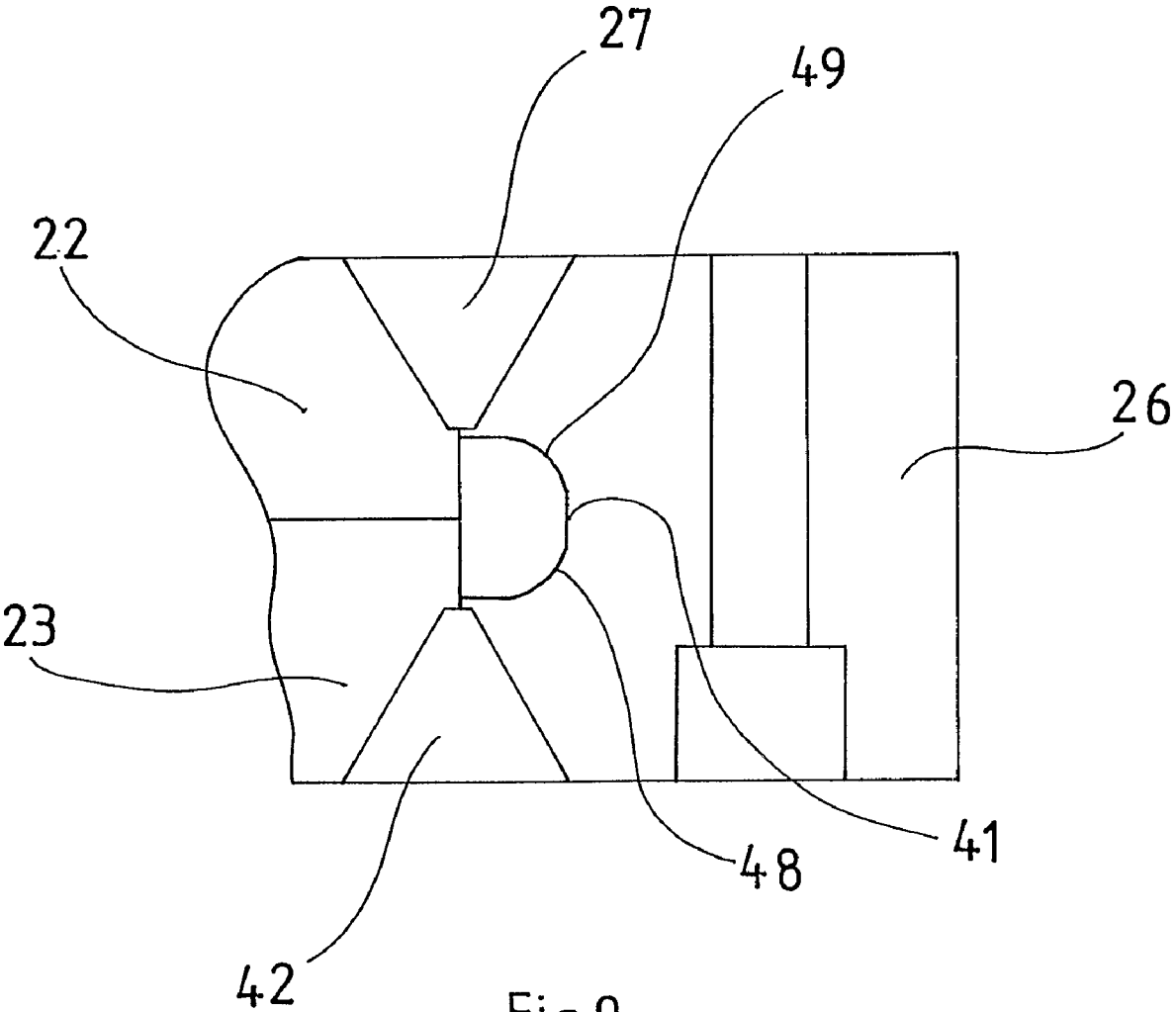
FIG. 9 is a detailed view of the apparatus of FIG. 8.

FIG. 9 is a detailed view of the area around the anchorage between the first part 22 and second part 23, respectively, and the frame section 26. The formation of this area is of crucial importance and affects how the membrane 20 can move and compensate for deformations. In order to cater for the extreme stresses that occur when the tool is working in a hydraulic press, great emphasis has been placed on mechanical strength properties in the formation of the upper welded joint 27 and the lower welded joint 42, as well as the circumferential groove 41. The circumferential groove 41 enters horizontally into the frame section 26 and has well rounded corners 48, 49 so that the forces are distributed uniformly around the surface of the groove. In addition, the inner surface of the groove is highly polished in order to minimize unevenness where fracture in the material may occur. By placing the upper welded joint 27 and the lower welded joint 42 above one another in a vertical plane which constitutes an abutment surface between the first part 22 and the second part 23, respectively and the frame section 26, superior mechanical strength will be obtained in the welded joints. The major part of the strain in the material of which the frame section 26 consists is taken up in connection with the circumferential groove 41.

Figure 10:
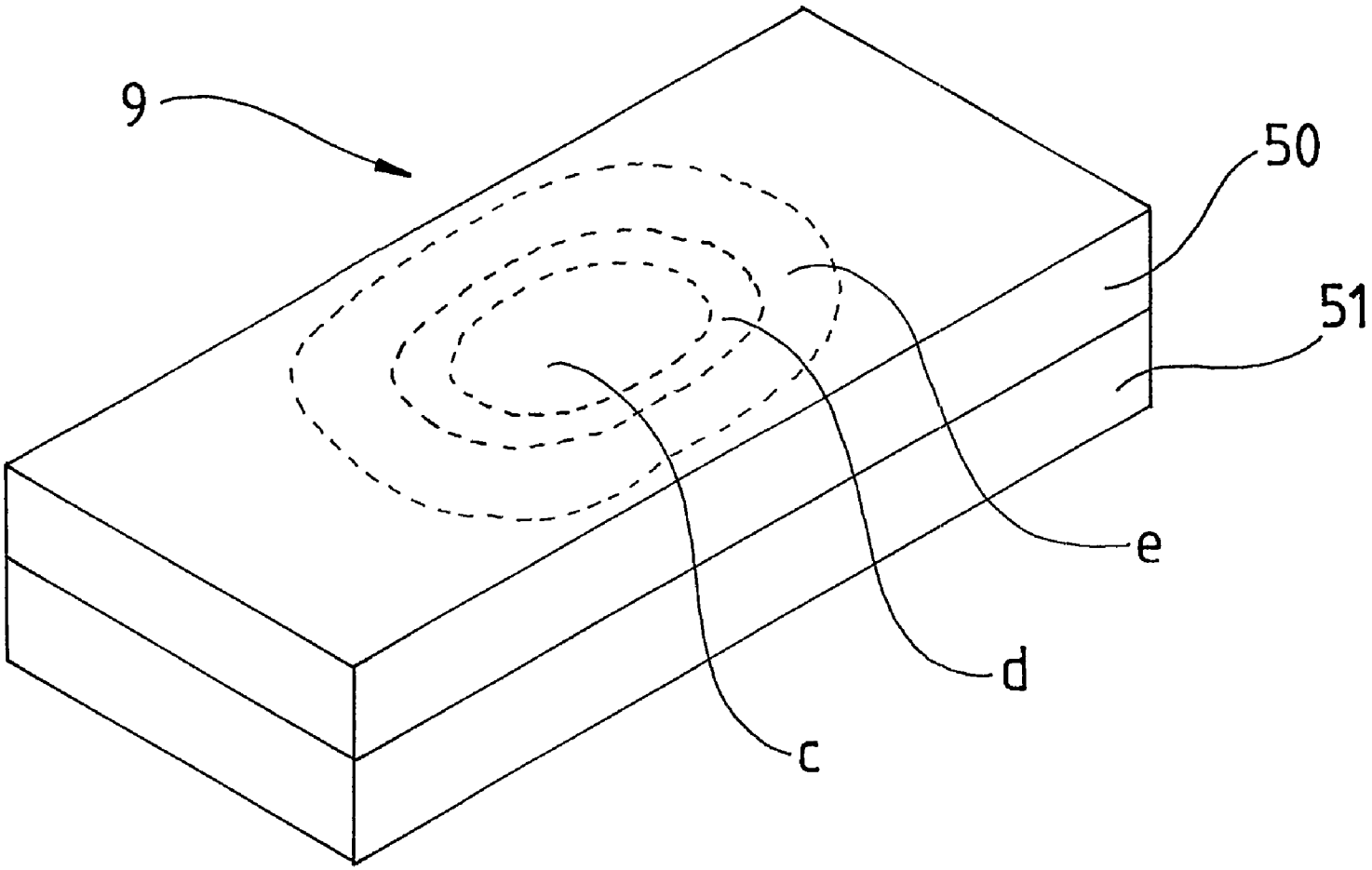
FIG. 10 shows the upper side of the tool and how the downward bending if distributed in the tool when an apparatus according to the present invention is disposed between the slide and the tool.

FIG. 10 shows the tool 9 and how the apparatus according to the present invention realises a downward depression of the central part of the tool 9. FIG. 10 shows the tool 9 in perspective view. The tool 9 consists of a first tool part 50 and a second tool part 51. The first tool part 50 and the second tool part 51 may be distanced from one another and the blank which is to be formed in the tool 9 is placed in between these two tool parts 50, 51. As a result of the increased compression pressure on the central area of the tool on the upper side of the tool, the blank which is placed between the tool part 50 and the tool part 51 will receive a more even stamping throughout its entire surface when the hydraulic press acts on the tool 9. The areas c, d, e are visible in the figure. The areas c, d, e show areas of different pressure which the apparatus according to the present invention gives rise to when it acts on the tool 9. In the central area c of the tool 9, a compression pressure occurs which is greatest. This compression pressure declines outwardly, and so the area d shows a compression pressure which is less than the area c, and area e shows a compression pressure which is less than area d. The areas are shown schematically in this figure. The change in the vertical direction corresponds to the compression pressure, i.e. the change in the vertical direction of the material in the tool 9 is greatest in area c and less in area d and e. Thus, areas c, d, e show that where most change in the vertical direction is needed for realising a higher compression pressure, i.e. centrally in the tool 9, the apparatus according to the present invention also gives rise to the greatest change and compression pressure. If the apparatus according to the present invention had not been placed between the tool 9 and the slide, a more uneven distribution of the compression pressure would have been obtained in the tool 9, which would have resulted in the blank placed between the tool part 50 and part 51 would have been stamped more unevenly. The stamping action would have been greater at the edges and less in the central areas of the blank.

The embodiment of the present invention described in the foregoing may be varied in numerous different ways. It will readily be perceived by the skilled reader that the positioning of the apparatus 20 shown in FIG. 3 may be varied. For example, additional apparatuses 20 may be placed on the underside 21 if necessary. In the foregoing description, we have spoken about placing the apparatus 20 or several apparatuses of the type 20 between the slide 8 and the tool 9, in other words in the contact area 56 which is shown in FIG. 1. It is also conceivable to place one or more apparatuses 20 on the second clamping surface 55 on the work table 10. The apparatuses 20 then act in the contact area 57 between the second clamping surface 53 on the work table 10 and the second abutment surface 55 on the tool 9. By such means, additional compensation can be attained for improving the results on pressing in the tool 9.

The configuration of the apparatus shown in FIGS. 5, 6, 7 and 8 may be varied. The size of the apparatus may also be varied. Thus, it is conceivable to provide, for example, totally square configuration, triangular configuration, circular configuration, as well as a configuration with more than four edges, for example a hexagonal or octagonal configuration. All of this is with a view to achieving the best possible compensation in the press. Thus, the configuration of the apparatus 20 is completely free and it may be designed in the manner which best suits any given practical application.

FIG. 7 shows the holes 32 which are intended for the screw which is to secure the membrane 20 in, for example, the slide 8 or the work table 10. Since extremely high forces act on the membrane in the press, the securement of the membrane must be made slightly resilient in order to prevent the anchorage screw from breaking. This somewhat resilient securing can, for example, be realised with the aid of a spring washer which is placed between the membrane and the fixing screw in order to compensate for the configurational change which takes place when the membrane is working. It is also conceivable to provide different types of springs which permit a certain resilient springing in order to protect the fixing screws from breaking.

The present invention is not restricted to the embodiment described in the foregoing, but may be varied without departing from the scope of the appended Claims.

What is claimed is:

1. A method for locally increasing pressing pressure in a press tool having a first tool part clamped to a first clamping surface in a press and a second tool part clamped to a second clamping surface in the press, the method comprising:

providing a power unit smaller than the first tool part, the first clamping surface larger than the first tool part and the second clamping surface larger than the second tool part, positioning the power unit between the first tool part and the first clamping surface so that said power unit is not in contact with a work piece during operation of said power unit and said power unit having an internal space, pressing said work piece between the first and second tool parts by activating press cylinders in the press, allowing a slide to be deformed under influence of pressure, connecting the internal space to a source of pressurized hydraulic fluid; and supplying said pressurized hydraulic fluid to the internal space thereby causing the power unit to expand to exert a local pressure on the first tool part to compensate for the deformation of the slide.

2. The method as claimed in claim 1, further comprising providing the power unit with a flat configuration.

3. The method as claimed in claim 1, further comprising recessing the power unit in one of the clamping surfaces.

4. The method as claimed in claim 1, further comprising providing the power unit with two plates, defining the internal space between the plates, circumscribing the plates by a frame member, and permanently fastening the plates to the frame member.

5. A method for pressing an article in a press having a movable slide and a work table and fastened therebetween a pressing tool, said method comprising:

providing the movable slide with a length which is larger than the length of said pressing tool;

exerting a pressure on the movable slide at a number of locations distributed over a first surface of the movable slide and deforming the movable slide under influence of such pressure;

positioning a power unit between a clamping surface on the movable slide and an abutment surface on the tool abutting said clamping surface so that said power unit is always out of direct contact with said article, wherein the power unit is provided smaller than the abutment surface and the clamping surface; and providing an internal space in the power unit; and supplying a pressurized fluid into the internal space, thereby causing the power unit to expand and to exert a local increase in pressure between the clamping surface and the abutment surface abutting said clamping surface to compensate for the deformation of the movable slide.

6. A method as claimed in claim 5, wherein the abutment surface is smaller than the clamping surface.

7. The method as claimed in claim 5, further comprising providing the power unit with a flat configuration.

8. The method as claimed in claim 5, further comprising recessing the power unit in the clamping surface.

9. The method as claimed in claim 5, further comprising providing the power unit with two plates, defining the internal space between the plates, circumscribing the plates by a frame member, and permanently fastening the plates to the frame member.

10. A method for pressing an article in a press having a work table and a slide moveable under influence of a number of press cylinders, a first tool part of a press tool being fastened to the slide and a second tool part being fastened to the work table, the method comprising:

providing the moveable slide with a length greater than the length of said first and second tool parts;

activating the press cylinders for pressing with a pressure to a work piece between the first and second tool parts;

allowing the slide to be deformed under influence of pressure;

providing a power unit between the first tool part and the slide, wherein the power unit is provided smaller than the first and second tool parts; and providing an internal space in the power unit; and supplying a pressurized fluid into the space, thereby causing the power unit to expand and to exert a local increase in pressure between the slide and the first tool part without the power unit contacting the work piece, in order to compensate for the deformation of the slide.

* * * * *